United States Patent [19]

Howard

[11] Patent Number: 4,782,756

[45] Date of Patent: Nov. 8, 1988

[54] PRINTING PRESS ROLLER INK REMOVER

[76] Inventor: Paul C. Howard, 10006 Karmont Ave., South Gate, Calif. 90280

[21] Appl. No.: 133,108

[22] PCT Filed: Apr. 28, 1986

[86] PCT No.: PCT/US86/00893

§ 371 Date: Nov. 3, 1987

§ 102(e) Date: Nov. 3, 1987

[87] PCT Pub. No.: WO87/06528

PCT Pub. Date: Nov. 5, 1987

[51] Int. Cl.[4] ..... B41F 35/04

[52] U.S. Cl. ..... 101/425; 101/348; 101/365

[58] Field of Search ..... 101/425, 167, 169, 363, 101/364, 365, 350, 349, DIG. 24, DIG. 26; 60/523

[56] References Cited

U.S. PATENT DOCUMENTS

| | | | |
|---|---|---|---|
| 2,382,103 | 8/1945 | Sandman | 101/351 |
| 2,786,413 | 3/1957 | Richter | 101/425 |
| 3,128,207 | 4/1964 | Schmitt | 101/169 |
| 4,192,231 | 3/1980 | Kawakami | 101/425 |
| 4,479,434 | 10/1984 | Armelin | 101/365 |

FOREIGN PATENT DOCUMENTS

| | | | |
|---|---|---|---|
| 691703 | 8/1964 | Canada | 60/527 |
| 639293 | 11/1936 | Fed. Rep. of Germany | 101/350 |
| 319962 | 4/1957 | Switzerland | 101/364 |
| 768968 | 2/1957 | United Kingdom | 101/169 |
| 2024457 | 1/1980 | United Kingdom | 101/DIG. 26 |
| 2080201 | 2/1982 | United Kingdom | 101/DIG. 26 |
| 2171517 | 10/1986 | United Kingdom | 60/527 |

OTHER PUBLICATIONS

Rockwell Int'l./'The Computer Controlled Inking System'/All/01-1984.

*Primary Examiner*—Edgar S. Burr
*Assistant Examiner*—Kimberly L. Asher
*Attorney, Agent, or Firm*—Albert O. Cota

[57] ABSTRACT

A printing press roller ink remover which has a solid ink transfer roller (20) that is contiguously driver by the press ink roller. The invention includes a plurality of side by side scraping blades (24) that selectively engage the roller to remove the transferred ink. A separated ink collector roller (26) receives the removed ink and is scraped clean by a single doctor blade (28) which deposits the ink on to a disposable liner (32) in a pan (30) underneath. The separate blades (24) are placed into their scraping position, either manually, or driven by pneumatic or electrical power. Selection is made by microprocessor signals, or by the operator, to uniformly correct the color density of the printing material.

10 Claims, 2 Drawing Sheets

PRINTING PRESS ROLLER INK REMOVER

TECHNICAL FIELD

The present invention relates to the cleaning of ink rollers of a printing press in general, and more specifically to removal of ink utilizing a pair of rollers with sectionalized doctor plates.

BACKGROUND ART

Previously, many types of cleaning devices and processes have been devised to provide an effective means to clean the ink from a printing press used in lithography or a specific letter press. Many of these processes entail the use of cleaning solvents and liquids in direct contact with the ink roller. Considerable effort has also been displayed in the problems of wear and adjustment of doctor blades that are used to scrape ink from rollers and printing plates.

In most cases, prior art has been concerned with simply the cleaning directly of the roller, or plate, or with a full width doctor blade, of some type, that removes the ink primarily by scraping the surface.

A search of the prior art did not disclose any patents that read directly on the claims of the instant invention, however, the following U. S. patents were considered related:

| U.S. Pat. No. | Inventor | Issue Date |
|---|---|---|
| 4,359,799 | Boose | Nov. 23, 1982 |
| 4,254,709 | Arnolds | Mar. 10, 1981 |
| 4,192,231 | Kawakami | Mar. 11, 1980 |
| 4,151,797 | Dunsirn | May 1, 1979 |
| 3,884,145 | Datwyler | May 20, 1975 |
| 3,468,248 | Giori | Sep. 23, 1969 |

Boose teaches a doctor plate made of an assembly consisting of the doctor knife blade, a back-up blade, and a rigid holder. Each blade is accurately straight and offers the advantage that wear may take place without causing unacceptable alteration of the profile of the scraping, or doctor edge, engaging the printing roll.

Arnolds utilizes a flexible blade with a collecting pan and a mechanism, when in use, includes a locking lever that cooperates with the saddles on the press to lock the ink pan and cleaning blade assembly in position on an angle bracket. Cam means cause movement of the bracket so that the cleaning blade contacts the ink roller. Adjustment is allowed to move the entire mechanism closer to the roller, as the flexible blade wears down through use.

Kawakami discloses an apparatus for automatically washing a doctor blade for removing ink from the ink rollers of a printing press. This is accomplished using a washing vessel with a reciprocating brush that is in contact with the doctor blade and means for spraying washing liquid on the brush device. The blade is cleaned while it is reciprocated and scrubbed by the brush. The doctor blade is made of a thin resilient material of synthetic resins, such as polycarbonate, so that it does not injure the rotating surface of the press roller.

Dunsirn is concerned with maintaining an even and constant pressure of the doctor blade onto the roller. This is accomplished by the utilization of an independently slideable and pivotal support that is spring loaded. The apparatus allows movement of the mounting plate and the blade with pressure adjustments independently at each of four posts.

Datwyler has approached the problem of doctor blade wear by applying a number of individual sections on top of a support element. These individual sections are connected, one with another, and are selectively removable, so that by withdrawing individual sections, the distance between the contact surface and the last section is maintained essentially constant during the progressive wear of the contact surface.

It will be seen that this problem of ink cleaning has been approached in many different and varied ways, however, none have been concerned with removing a selected quality of ink from a predetermined area or by automatic means.

DISCLOSURE OF THE INVENTION

The problem of cleaning ink from an ink roller of a printing press has been with us for many years, however, as the cost of labor has increased, the methods of manual cleaning has become more critical. Further, labor is involved in the adjustment of the thickness of ink on the ink roller to control the color density of the printing. The thicker the ink, the darker the copy. One of the unsolved problems with color lithography is the consistant density of ink along the entire surface. If one area is thicker than the other, colors are not true on the printed sheet and adjustment of the entire roller is necessary or cleaning the entire surface to remove built-up deposits causing the irregularity in density.

It is, therefore, a primary object of the invention to provide a method of correcting this difficulty by applying a secondary roller contiguous with the ink roller that contains a series of separate scraping blades that are individually engaged, allowing a certain amount of ink to be removed in predetermined areas. Where the ink is too thick, the blades simply engage the roller and scrape it off leaving the other sections unaffected. This allows the press to continue to operate when the adjustment is made. Since the problem of ink build-up on the ink roller is a self-perpetuating one in that the ink is attracted to the residue in greater volume, the problem is compounded to the point that the ink roller may have its utility destroyed. The make-up of the roller must be uniformly resilient as the surface may be damaged by this unwanted accumulation. The invention solves this problem by removing the ink in the unwanted area preventing excessive build-up from occuring in the first place. This object solves not only the color density problem, but also the deteriorating affect of build-up on the resilient ink roller.

An important object of the invention allows the blades to be retracted from the transfer roller in the exact location automatically by the use of light sensing transducers in conjunction with a microprocessor. This control may also be accomplished by visual observation and individually switching the sections into contact with simple on/off controls.

Another object of the invention is realized by the fact that the transfer roller may remove all of the ink from the ink roller without the need of solvents or shutting down the press. Color of ink may be changed in the reservoir of the press without affecting the rollers.

Still another object of the invention allows the ink to be removed from the device in a disposable liner made of paper or polyvinylchloride. The unwanted ink is removed from the transfer roller by the segmented blades and accumulates on a collector roller that gathers the ink without touching. The ink is removed from this roller by a conventional doctor blade and, by gravity, flows to the liner directly beneath. This allows the disposition of the unwanted ink to be made easily and without any scraping, or wiping, simply by removal and replacing a new liner in the collecting pan. With the ink on the liner, the operator does not have to handle the substance with tools or cloths, instead the liner is easily folded over and disposed of in a waste container.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
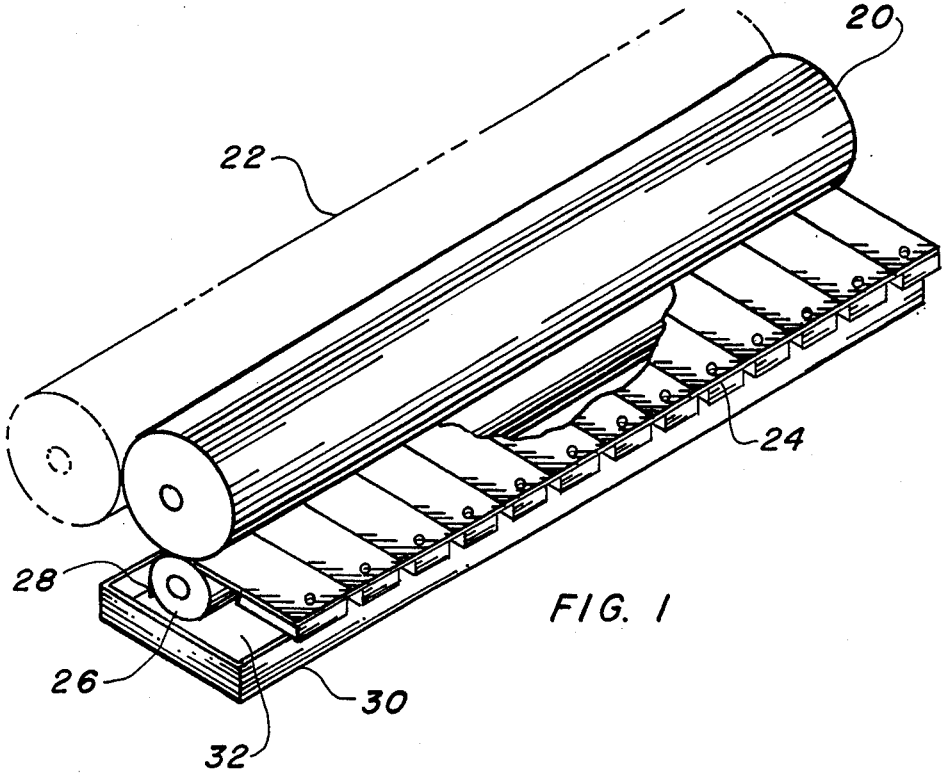
FIG. 1 is a partial isometric view of the preferred embodiment with the ink roller of the printing press shown in phantom.
Figure 2:
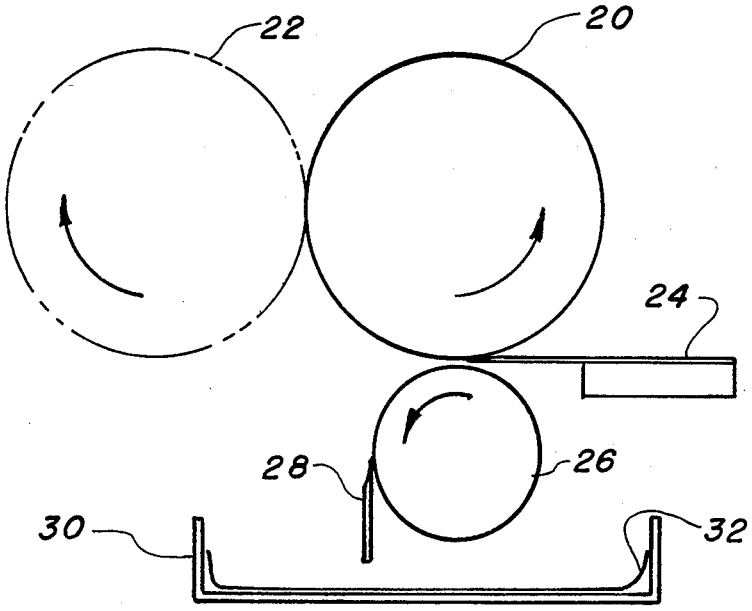
FIG. 2 is a schematic diagram of the preferred embodiment less the means to actuate the blades.

The best mode for carrying out the invention is presented in terms of a preferred embodiment. The preferred embodiment includes three separate blade actuating means and the addition of an optional microprocessor controller to automatically control the system function in response to color density. The preferred embodiment, as shown in FIGS. 1 and 2 is comprised of a solid ink transfer roller 20 that is located in the ink roller portion of the printing train contiguously engaged to the ink roller 22 of a letterpress or lithographic printing press. The transfer roller 20 is made of solid hard material, such as steel, and is ground and polished to a uniform diameter with a smooth surface. This transfer roller 20 is positioned tight enough to the resilient printing press ink roller 22 to allow counter rotation any time the press is in operation. This contiguous relationship allows the ink that has been placed on the ink roller 22 to coat both outside surfaces simultaneously in a corresponding relationship. This orientation provides a continuing correlation between the two allowing the effect of one roller to be shared with the other, not only in the application, but also in the removal of ink.

A plurality of movable ink scraping blades 24 are positioned side by side in parallel relationship with the centerline of both rollers 20 and 22 and tangent, at least, to the transfer roller 20, preferably on the bottom surface. The blades 24 have a sharp edge that is in contact with the roller 20 and are of uniform width that allow a continuous surface to engage the entire length of the roller 20. These blades 24 further contain structure allowing them to slide independently in and out of contact with the roller 20. This configuration is shown in FIG. 1, however, may be varied in shape and structure and still fall within the scope of this invention. The scraping action of the blades 24, as they frictionally engage the surface of the roller 20, remove the ink evenly and uniformly along the entire width and as the blades are formed so that they touch each other on each side they create, in essence, a single scraping surface when they are uniformly engaged.

When ink is to be removed from the ink roller 22, all of the blades 24 simultaneously engage and the ink is removed on the bottom surface of the blade as the top portion is pressing against the solid roller 20. Color density of ink on paper is governed by the thickness of the coating. The thicker the ink, the darker the color, as the ink is almost transparent on the paper, or at least, translucent in the colored form. In printing colors, the uniformity of thickness becomes an important aspect and as the thickness is normally governed by the adjustment of the ink reservoir with its plurality of threaded screws along a vee-shaped storage reserve. Adjustment is not always easy as sometimes certain portions of the roller 22 attract more ink than others and once the ink is on it is removed only by use. For this reason, the invention provides the blades 24 with the individual adjusting feature that allows one or more blades to contact the surface in response to the ink build-up in a given area. The movement is in either a fully engaged or disengaged position, however, with sufficient quantity of blades 24, the particular section is easily controlled.

When the ink is scraped from the roller 20 on the bottom surface, it accumulates on the bottom of the blade 24 and an ink collector 26 is located directly beneath the blade 24, very close, but not actually touching. This relationship allows the surplus ink to be distributed to the collector roller 26. The collector roller 26 is rotated in the opposite direction, as the transfer roller 20, by means not illustrated, but included in the drive system of the press. The actual speed of this roller 26 is of little relevance, as it is independent in its operation.

As the outside of the roller 26 now contains the surplus ink it is removed by the use of a doctor blade 28 angularly positioned against the scraping blades 24 This blade 28 is shown best in FIG. 2 and is of the conventional type running the full length of the roller 26. The unwanted ink is collected on this doctor blade 28 until it builds-up sufficient thickness to move by gravity downward to the edge or may be wiped off.

Immediately beneath the blade 28 and roller 26 is an ink collecting pan 30 that is slightly larger than the assembly and provides a convenient area to store the surplus ink removed from the printing press.

For convenience of operation disposable liner 32 means are positioned in the pan 30 directly under the blade 28. This position is selected so as to be in direct alignment with the blade and yet flat on the bottom of the pan. When sufficient mass is collected, the ink flows by gravity downward and drops on the liner means 32. This liner 32 may be any material suitable for the purpose, however, paper or thermoplastic film, such as polyvinylchloride of a size and shape as to fit inside of the collecting pan 30 directly underneath the blade 28 is preferred.

As the ink scraping blades 24 are retracted in an individual manner, means are required to accomplish this movement. Manually sliding each blade either forward into the roller 20 or away is easily accomplished by grasping the blade or a knob of any type (not illustrated) may be added for operator convenience.

Figure 3:
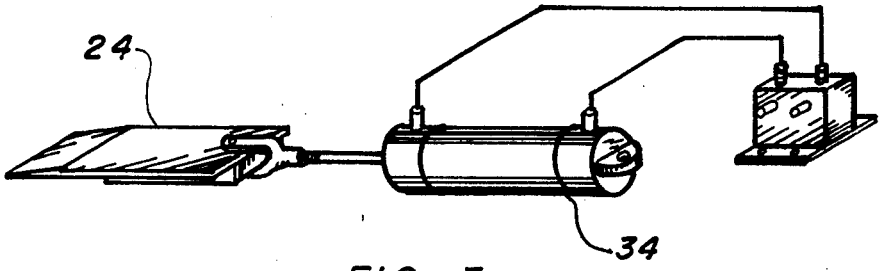
FIG. 3 is an isolated pictorial view of the blade removed from the invention with the means to retract being a pneumatic cylinder.

Another means to retract individual blades 24 consists of separate pneumatic cylinders 34 each attached linearly to a blade 24. Control of this cylinder 34 may be made by any method known in the art, including an electromechanical control valve 36 that is energized by an electrical signal providing pressurized air to one side of the cylinder 34 while relieving the pressure from the other. This arrangement is illustrated in FIG. 3, shown completely removed from the invention for clarity.

Figure 4:
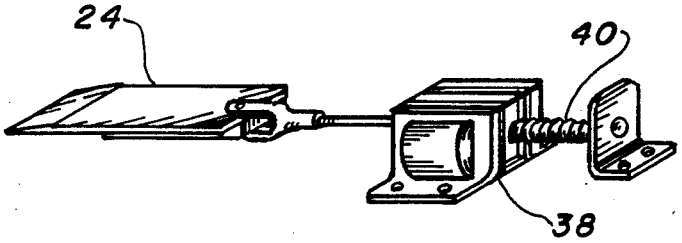
FIG. 4 is an isolated pictorial view of the blade removed from the invention with the means to retract being an electromechanical solenoid.

FIG. 4 depicts another embodiment of this means to retract the blades 24 and consists of an electromechanical solenoid 38 biased with a compression spring 40. Normally the spring 40 holds the blade 24 in intimate contact with the roller 20 and upon receiving an electrical circuit the solenoid 38 creates a magnetic field pulling an armature into the solenoid compressing the spring 40 and holding it inside as long as the circuit is completed. When the power is interrupted the spring 40 returns the blade 24 into its contact position. This arrangement may easily be reversed with a lever, as shown in FIG. 5, with the addition of a spring in tension.

Figure 5:
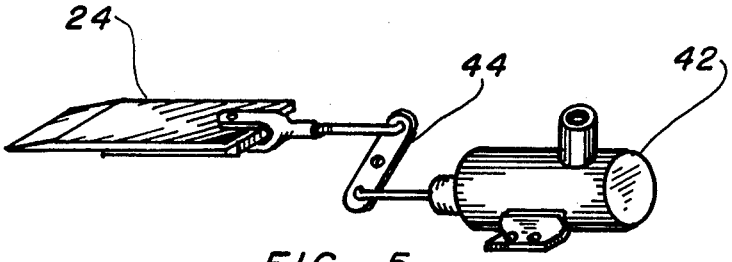
FIG. 5 is an isolated pictorial view of the blade removed from the invention with the means to retract being a thermal expansion device.

Another means is shown in FIG. 5 wherein a thermal expansion device 42 is connected to the blade 24 through a reversing lever 44. The expansion device 42 functions with a heater element inside the cylinder-like body with a paraffin based substance inside. When the heater is electrically energized, the substance, which has a high coefficient of expansion increases in volume forcing a rod outward from the cylinder to its attachment with the lever. The lever 44 reverses the direction of thrust removing the blade from contact with the roller 20. When the power is interrupted, the material contracts, returning the blade 24 into contact with the roller 20.

Figure 6:
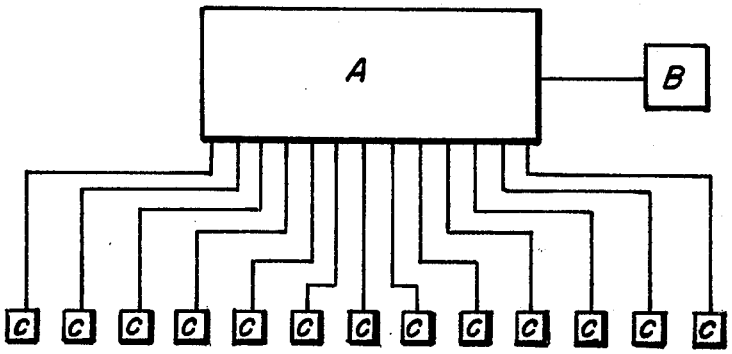
FIG. 6 is a block diagram of the invention utilizing a microprocessor controller to actuate the individual blades in response to color density.

Along with manual control of either the blade 24 itself or the electrical energy by switches the blades 24 may include, in the means to retract, a microprocessor controller that senses the color density through light sensing elements. This is pictorially illustrated in a block diagram in FIG. 6. The controller (computer) is designated "A" and receives an analog signal from the light sensor "B", indicating a variation in color that is of sufficient magnitude as to be correctable by the removal of ink in predetermined areas. The means to retract the blades, shown in FIGS. 3 through 5, are designated "C" on the block diagram and are electrically energized by the controller "A" as individually called for.

For simple cleaning purposes, all of the blades 24 are in contact with the roller 20 simultaneously either manually controlled or overriding the control system of the computer.

While the blades 24 are shown in the normal position of contact with the roller 20 in FIGS. 3 through 5, this is easily reversed allowing the blades to be normally disposed away from engagement in an optional preference. Many applications would use this approach, as the preferred embodiment and the invention is not limited specifically to either the energize to contact or energize to remove method of actuation.

The mechanical details of the location of the sensor or sensors and the blade positioning and retracting means is not shown as they are well known in the art and vary according to the configuration of the specific printing press.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. A printing ink removing apparatus for lithographic printing presses and letter presses comprising:

(a) a solid ink transfer roller contiguously engaging and rotated by an ink roller on said printing press, conveying a portion of ink therefrom;

(b) a plurality of movable ink scraping blades having a sharp edge tangentially engaging the surface of said transfer roller at its lowest point in such a manner as to selectively remove ink from the exterior when rotated thereupon, for cleaning purposes and controlling color density;

(c) an ink collector roller intimately adjacent to the joint of engagement said ink scraping blades with said transfer rollers and directly beneath said transfer roller to collect surplus ink;

(d) a doctor blade tangentially engaging the entire length of said ink collector roller with said doctor blade continuously removing ink from the surface of the collector roller; and, (e) an ink collecting pan positioned under said doctor blade to accumulate the ink removed from said printing press.

2. The invention as recited in claim 1 wherein said ink transfer roller further comprises: steel material ground and polished to a smooth concentric outside diameter.

3. The invention as recited in claim 1 further comprising: disposable liner means positioned within said ink collecting pan in a select location as to accumulate the ink removed by the doctor blade, as it flows by gravity on the surface of the blade downward and drops onto the liner means.

4. The invention as recited in claim 3 wherein said disposable liner means is comprised of paper of a size and shape as to fit inside of said collecting pan directly underneath said doctor blade.

5. The invention as recited in claim 3 wherein said disposable liner means is comprised of polyvinylchloride thermoplastic film of a size and shape as to fit inside of said collecting pan directly underneath said doctor blade.

6. The invention as recited in claim 1 further comprising means to retract individual ink scraping blades in a selective manner independent of each other.

7. The invention as recited in claim 6 wherein said means to retract blades further comprises a plurality of pneumatic cylinders each attached linearly to an individual ink scraping blade driving the blade into contact with the ink transfer roller in one position and retracting away in another.

8. The invention as recited in claim 6 wherein said means to retract blades further comprises a plurality of electromechanical solenoids each attached linearly to an individual ink scraping blade spring loading the blade into contact with the ink transfer roller in one position and electromechanically withdrawing the blade against spring pressure in another.

9. The invention as recited in claim 6 wherein said means to retract blades further comprise a plurality of thermal expansion devices attached through a reversing lever linearly to individual ink scraping blades making contact with the ink transfer roller in the normal position and retracting away from the roller when an electrical circuit is energized heating a paraffin based substance contained inside causing thermal expansion to linearly move the blade away from the roller by the reverse action of said lever.

10. The invention as recited in claim 6 wherein said means to retract individual ink scraping blades is controlled by a microprocessor controller in response to color density input.

* * * * *